US006659719B2

(12) United States Patent
Angelis

(10) Patent No.: US 6,659,719 B2
(45) Date of Patent: Dec. 9, 2003

(54) VENTILATOR HOUSING, IN PARTICULAR, FOR AXIAL VENTILATORS

(75) Inventor: Walter Georg Angelis, St. Georgen (DE)

(73) Assignee: Papst-Motoren GmbH & Co. KG, St. Georgen (DE)

( * ) Notice: Subject to any disclaimer, the term of this patent is extended or adjusted under 35 U.S.C. 154(b) by 78 days.

(21) Appl. No.: 09/995,932

(22) Filed: Nov. 28, 2001

(65) Prior Publication Data

US 2002/0067988 A1 Jun. 6, 2002

(30) Foreign Application Priority Data

Dec. 1, 2000 (DE) ..... 200 20 512 U

(51) Int. Cl.[7] ..... F04D 29/54
(52) U.S. Cl. ..... 415/211.2; 415/220; 415/914
(58) Field of Search ..... 415/119, 148, 415/149.2, 175, 176, 208.1, 208.2, 211.2, 220, 914

(56) References Cited

U.S. PATENT DOCUMENTS 1,752,427 A 4/1930 Fales
3,531,221 A 9/1970 Herberg et al. ..... 230/117
5,393,197 A 2/1995 Lemont et al. ..... 415/68
5,816,781 A * 10/1998 Bercot et al. ..... 417/371
6,502,383 B1 * 1/2003 Janardan et al. ..... 415/914 X

FOREIGN PATENT DOCUMENTS

FR 2 358 550 2/1978
GB 2355766 A * 5/2001 ..... F02K/1/46
JP 53115912 A * 10/1978 ..... F04D/29/52

* cited by examiner

*Primary Examiner*—Edward K. Look
*Assistant Examiner*—Richard Edgar
(74) *Attorney, Agent, or Firm*—Gudrun E. Huckett

(57) ABSTRACT

A ventilator housing of a ventilator has a flow passage having an intake opening and an outlet opening. Outflow contouring devices are arranged about the outlet opening and are configured to at least reduce a vortex formation within a shearing layer that is generated during operation of the ventilator so as to surround an actual airflow of the ventilator and that is located between the airflow and surrounding air. The outflow contouring devices enlarge the proportion of uninterrupted air flow relative to the entire flow cross-section of the flow passage.

3 Claims, 3 Drawing Sheets

VENTILATOR HOUSING, IN PARTICULAR, FOR AXIAL VENTILATORS

BACKGROUND OF THE INVENTION

1. Field of the Invention

The invention relates to a ventilator housing having a flow passage with an intake opening at one side and an outlet opening at the other side.

2. Description of the Related Art

Ventilators are often used for applications where a very uniform airflow, in particular, a laminar airflow, is to be provided across the entire flow cross-section. For example, in printing machines axial ventilators are arranged adjacent to one another, in particular, in a row arrangement, in order to supply large paper webs from above with an airflow after the printing process so that these paper webs can be placed or deposited more quickly onto a stack of paper webs. In this connection, a fluid-mechanical surface pressure is to be provided which is as high as possible and acts onto the web to enhance the force of gravity when placing the web onto the stack and thus push out the air at the underside of the web, present between the web to be deposited and the last-deposited web and impeding the placement of the web onto the stack. The deposition speed and deposition quality have a direct effect on the economic efficiency of the printing machine because they affect the speed of passage through the printing machine significantly. Because of this, an improvement of deposition and an increase of the deposition speed would cause directly an increase of the economic efficiency of the machine.

However, it was found especially for such ventilator applications that often the desired effect could not be achieved or achieved only to an unsatisfactory degree.

SUMMARY OF THE INVENTION

It is an object of the present invention to improve a ventilator housing of the afore described kind with respect to flow properties of the conveyed airflow, in particular, such that a ventilator provided with a ventilator housing according to the invention is suitable particularly for the above described use in printing machines.

In accordance with the present invention, this is achieved in that outflow contouring means are arranged in the area of the outlet opening so as to surround the flow cross-section of the outlet opening and are configured such that a vortex formation (large scale, low frequency) is reduced at least to some degree in a shearing layer, which surrounds the actual airflow resulting from ventilator operation and located between the airflow and the surrounding, usually stationary, air.

The invention is based on the recognition that behind each ventilator, naturally, a free jet is formed which mixes only at a certain distance with the surrounding air and/or with the free jet of neighboring ventilators. These free jets have the property that in their center a relatively low degree of turbulence is present. Toward the sides, the moving air which has been blown out mixes with the attracted stationary air within a shearing layer (entrainment effect). In this shearing layer, there exist almost exclusively large scale, low frequency vortex shapes. Because of their high energy contents, these vortex shapes have great longevity. In regard to the above described preferred applications, this has the result that the shedding of the vortices causes the printed web to be excited to perform vibrations at its resonant frequency. In certain situations, the resonant frequency of the paper webs correlates with the vortex shedding frequency. This mechanism prevents an increase of the deposition speed and can furthermore result in temporary disruptions of the deposition process.

By means of the outflow contouring means according to the invention, which are preferably serrated and arranged in a crown-shape about the outlet opening of the ventilator, the large-scale vortices in the shearing layer are broken up or their formation is prevented from the beginning. The excitation energy of the airflow onto the paper web in the preferred application of printing machines is thus drastically reduced and a corrugation of the paper web is prevented or at least reduced. The important advantages are thus as follows:

- stabilization of the free air jet,
- reduction of the large scale vortices in the edge area of the free air jet,
- reduction of low-frequency excitation components,
- noise advantages.

Further advantageous features of the invention will be described in the following.

DESCRIPTION OF THE PREFERRED EMBODIMENTS

Figure 1:
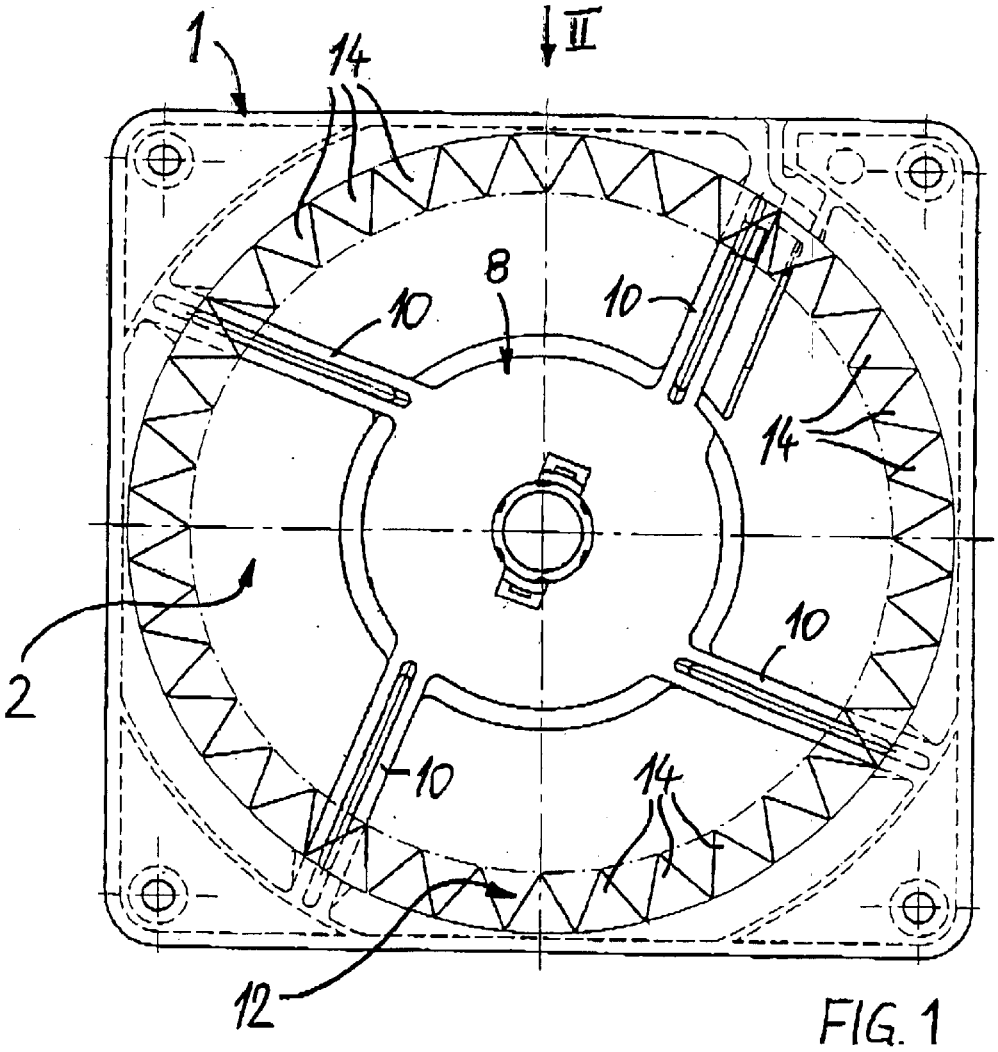
FIG. 1 is an axial end view (in the direction of arrow I in FIG. 2) of the outlet opening of a ventilator housing according to the invention according to a first embodiment.

Same parts illustrated in the Figures are identified with identical reference numerals.

The Figures show an axial ventilator housing 1 with an axial flow passage 2 having at one side an intake opening 4 and at the opposite side an outlet opening 6. The intake (inlet) opening 4 and the outlet opening 6 have a circular outer contour, respectively. This results in a substantially annular configuration of the axial ventilator housing 1 (so-called wall ring). Within the flow passage 2, central securing devices 8 for the motor/ventilator wheel module (not illustrated) are arranged wherein the securing devices 8 are connected by spoke-shaped connecting elements 10 with the outer housing ring. There is thus a circular or circular disc-shaped flow cross-section provided within the ventilator housing 1.

Figure 2:
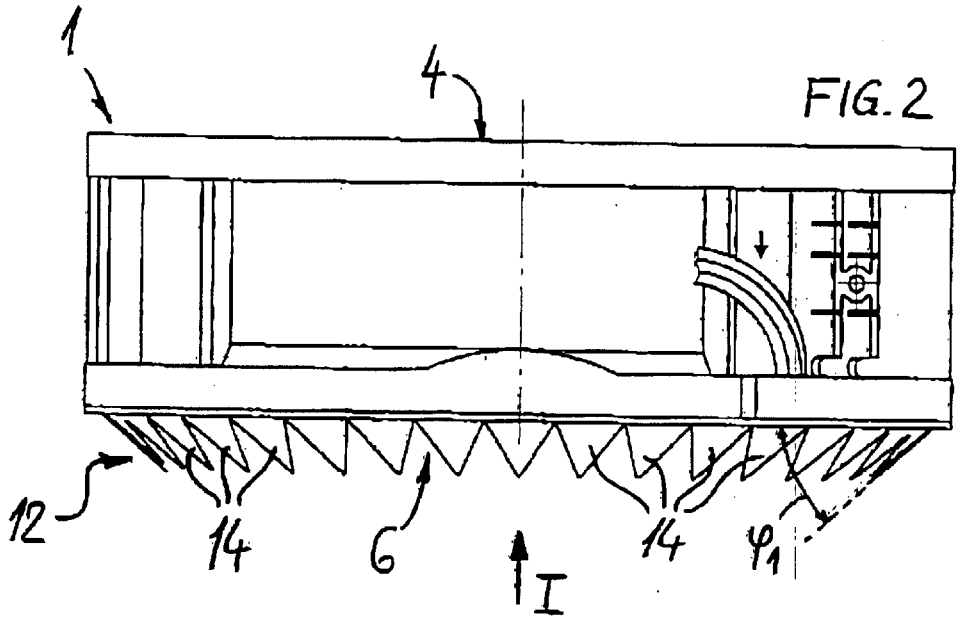
FIG. 2 is a side view in the direction of arrow II of FIG. 1.

According to the invention, in the area of the outlet opening 6 outflow contouring means 12 are provided which surround this flow cross-section. These outflow contouring means 12 are comprised essentially of individual contour elements 14 distributed about the periphery of the outlet opening 6. They project, beginning at the edge area of the outlet opening 6, partially into the flow shearing layer (FIG. 6) produced during operation and surrounding the actual airflow. In the preferred embodiments, the contouring elements 14 are shaped like the serrations of a crown with a substantially triangular contour, respectively. However, it is also possible to provide other polygonal and/or rounded contours. In all cases, the contouring elements 14 are fixedly connected by a base (in the illustrated case a triangle base) to the opening edge of the outlet opening 6 or to the area surrounding it at the housing end face; they project at a slant with the oppositely positioned tip or edge (in the illustrated embodiment with the triangle tip), on the one hand, axially in the flow direction and, on the other hand, radially inwardly or outwardly. In the first embodiment according to FIGS. 1 and 2, all contour elements 14 are slantedly oriented axially and radially inwardly, in particular, at an angle $\Phi_1$ relative to the radial plane (plane of the outlet opening 6 or the housing end face) beginning at the circumferential area of the outlet opening 6.

Figure 3:
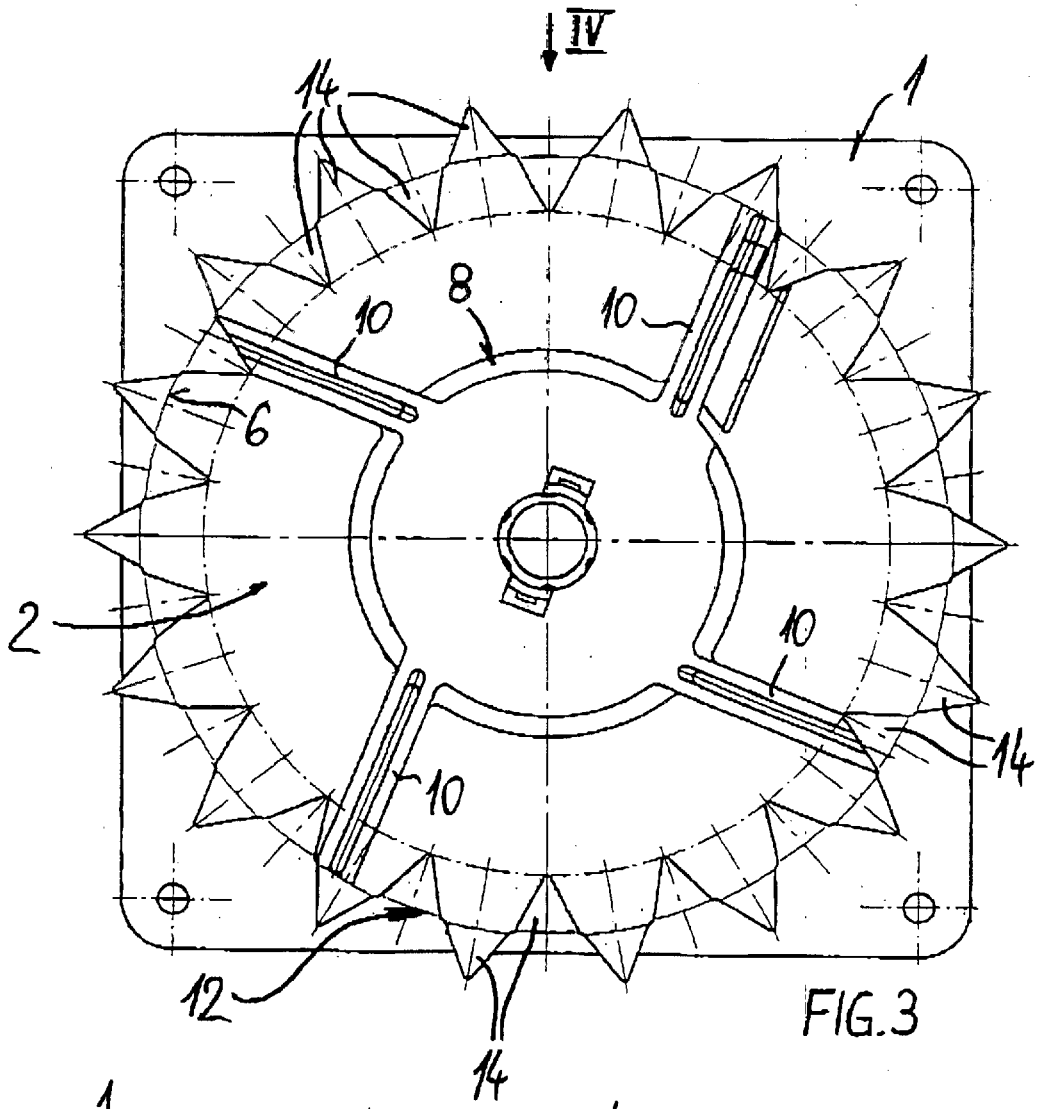
FIG. 3 is a view, analog to FIG. 1, of a second embodiment of the invention.
Figure 4:
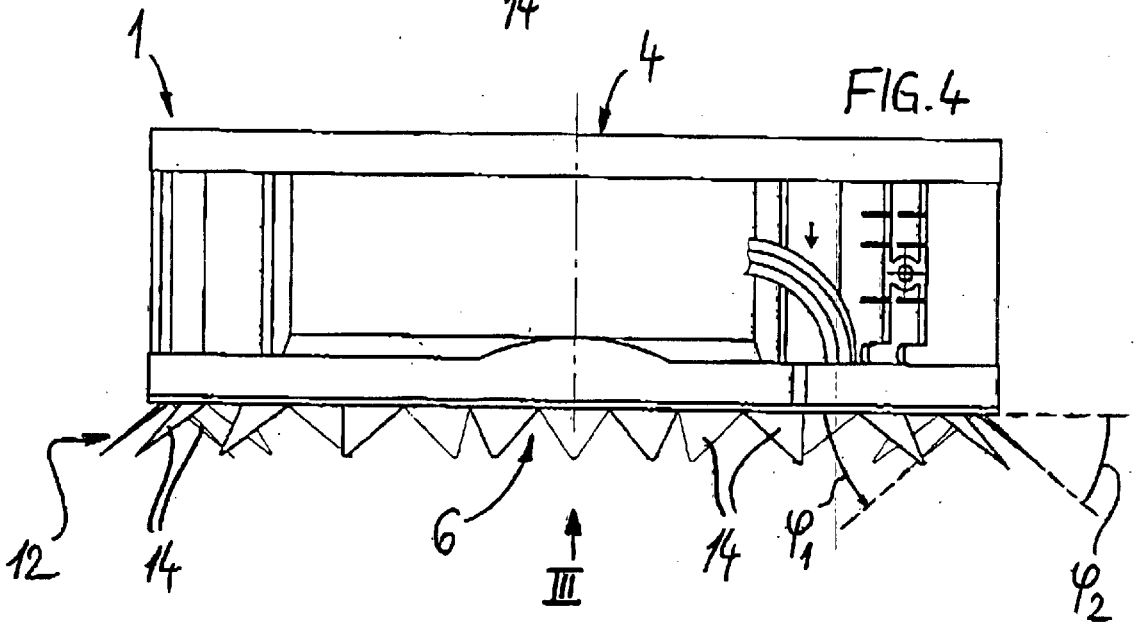
FIG. 4 is a side view in the direction of arrow IV of the embodiment of FIG. 3.

In the second embodiment according to FIGS. 3 and 4, several of the contour elements 14 are slantedly oriented axially and radially outwardly at an angle $\Phi_2$. As illustrated, the contour elements 14 are preferably arranged in the circumferential or peripheral direction alternatingly at an angle $\Phi_1$ at a slant axially and radially inwardly and at an angle $\Phi_2$ at a slant axially and radially outwardly.

It should be noted that the angles $\Phi_1$ and $\Phi_2$ can be identical or different. The respective angle $\Phi_1$ or $\Phi_2$ is in the range between 0° to 90°, respectively, and can be adjusted and matched—in the same way as the number, size, and contour shape of the contour elements 14—to the respective situation of use; in this connection, a combination of contour elements can also be provided which differ in regard to shape and/or size and/or angular position.

Figure 5:
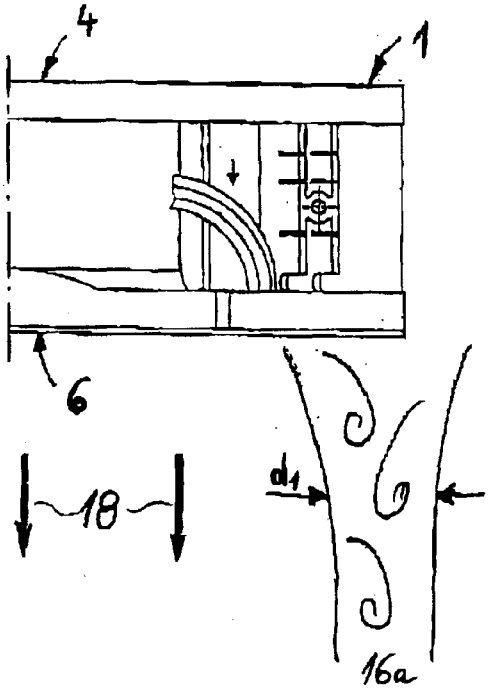
FIG. 5 is a partial side view of a conventional ventilator housing without outflow contouring means.
Figure 6:
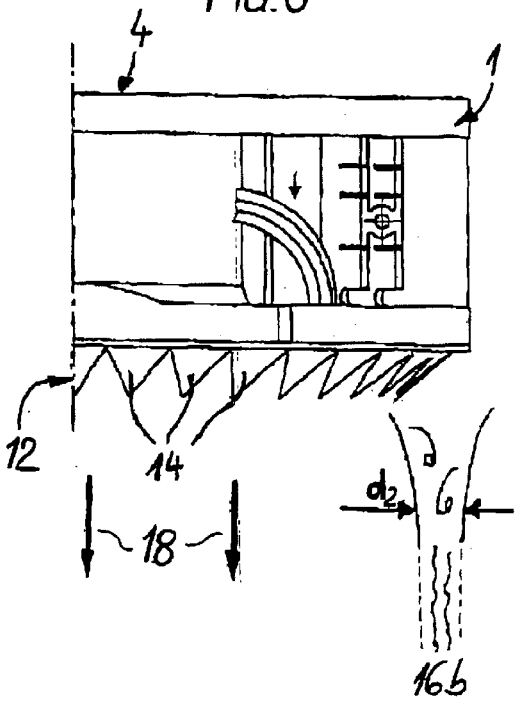
FIG. 6 is a partial side view of the embodiment according to the invention of FIGS. 1 and 2 for explaining the function of the invention in comparison to the conventional device of FIG. 5.

FIGS. 5 and 6 show in an exemplary fashion a comparison of the function of a conventional embodiment (FIG. 5) without contouring means 12 and of the embodiment (FIGS. 1 and 2) according to the invention (FIG. 6). In FIG. 5, it is illustrated that for a conventional "normal" axial ventilator an outer shearing layer 16*a* results which surrounds an inner uninterrupted airflow 18. This outer shearing layer 16*a* has a relatively large radial thickness $d_1$ and contains large scale vortices and a large component of low-frequency excitation components. This results in a relatively unstable free air jet. In contrast to this, FIG. 6 illustrates that the embodiment according to the invention results in a shearing layer 16*b* with reduced thickness $d_2$ and, within it, in a considerable reduction of large-scale vortices, a reduction of the low-frequency excitation components, and thus overall in a stabilized free air jet because the proportion of uninterrupted flow 18 relative to the entire flow cross-section is enlarged.

The invention is not limited to the illustrated and described embodiments but comprises also embodiments acting in the same way with respect to the gist of the invention. Moreover, the invention is not limited to the primary combination of features as defined in the independent claim but can also be defined by any other combination of select ones of the disclosed individual features.

While specific embodiments of the invention have been shown and described in detail to illustrate the inventive principles, it will be understood that the invention may be embodied otherwise without departing from such principles.

What is claimed is:

1. A ventilator housing (1) of a ventilator comprising:

a flow passage (2) having an intake opening (4) and an outlet opening (6);

outflow contouring means (12) arranged about the outlet opening (6) and configured to at least reduce a vortex formation within a shearing layer (16), generated during operation of the ventilator so as to surround an actual airflow (18) of the ventilator and located between the airflow (18) and surrounding air;

wherein the outflow contouring means (12) are comprised of individual contour elements (14) distributed in a peripheral direction of the outlet opening (6) and projecting from an edge area of the outlet opening (6) at least partially into an area of the shearing layer (16*b*);

wherein several of the contour elements (14) are slantedly oriented axially and radially outwardly; and wherein first ones of the contour elements (14) extend slantedly axially and radially outwardly and second ones of the contour elements (14) extend slantedly axially and radially inwardly, wherein the first and second contour elements (14) alternate in the peripheral direction of the outlet opening (6).

2. A ventilator housing according to claim 1, wherein the ventilator housing is an axial ventilator housing (1), wherein the intake opening (4) and the outlet opening (6) have a circular outer contour, respectively, and are arranged axially opposed to one another, and wherein within the flow passage (2) securing devices (8) configured to secure a motor/ventilator wheel module within the ventilator housing (1) are arranged.

3. A ventilator housing according to claim 1, wherein the contour elements (14) have a triangular contour and are arranged in a crown shape about the outlet opening (6).

* * * * *